US005538577A

United States Patent [19]

Negoro

[11] Patent Number: 5,538,577

[45] Date of Patent: Jul. 23, 1996

[54] THERMAL TRANSFER RECORDING MATERIAL

[75] Inventor: Toshihiko Negoro, Osaka, Japan

[73] Assignee: Fujicopian Co., Ltd., Osaka, Japan

[21] Appl. No.: 346,095

[22] Filed: Nov. 29, 1994

[30] Foreign Application Priority Data

Nov. 30, 1993 [JP] Japan ..... 5-300282

[51] Int. Cl.[6] ..... B41M 5/26; B41M 5/40

[52] U.S. Cl. ..... 156/235; 428/195; 428/341; 428/913; 428/914

[58] Field of Search ..... 8/471; 428/195, 428/913, 914, 341; 503/227; 156/235

[56] References Cited

FOREIGN PATENT DOCUMENTS 63-317386 12/1988 Japan ..... B41M 5/26

*Primary Examiner*—B. Hamilton Hess
*Attorney, Agent, or Firm*—Fish & Neave

[57] ABSTRACT

A thermal transfer recording material comprising a foundation, and (A) a coated area of at least one heat-meltable ink and (B) a coated area of a release agent or a release composition containing a release agent provided on the foundation, the coated area (A) and the coated area (B) being repeatedly arranged in a side-by-side relation on one side of the foundation, the release agent being at least one member selected from the group consisting of a silicone oil, an alkyl phosphate, a fluorine-containing surface active agent, a silicone resin, a silicone-modified urethane resin, a silicone-modified acrylic resin and a fluorine-containing resin. The thermal transfer recording material is favorably used in a reheating method wherein the heat-meltable ink is transferred onto a receptor, especially a receptor having a porous surface layer, and the ink image formed on the receptor is heated under the condition that the release agent-coated area (B) of the recording material is superimposed on the ink image.

7 Claims, 1 Drawing Sheet

THERMAL TRANSFER RECORDING MATERIAL

BACKGROUND OF THE INVENTION

The present invention relates to a thermal transfer recording material. More particularly, it relates to a thermal transfer recording material useful for forming ink images having a smooth surface on a receptor having a porous surface layer.

Heretofore there was proposed a thermal transfer recording method using a thermal transfer recording material wherein a coated area of a heat-meltable ink and an uncoated area thereof are repeatedly arranged in a side-by-side relation on one side of a foundation. The method comprises: selectively transferring the heat-meltable ink of the coated area by means of a thermal head to form ink images on a receptor paper, superimposing the uncoated area of the ink on the recording material onto the image-bearing surface of the receptor paper, and heating the ink images by means of the thermal head to permit the ink of the images to penetrate voids between the fibers of the receptor paper, thereby giving ink images having excellent abrasion resistance and durability (Japanese Unexamined Patent Publication No. 103488/1989). Hereinafter this method is referred to as reheating method.

On the other hand, there was developed as a receptor for use with a thermal transfer recording material a receptor having a porous surface layer (hereinafter referred to as porous surface receptor) wherein a resinous layer having a large number of minute pores is formed on a film substrate (Japanese Unexamined Patent Publication No. 41287/1990).

Although the porous surface receptor has been subjected to a smoothing treatment in the production thereof, the surface of the receptor is still uneven and poor in smoothness. Accordingly, the ink image formed on the receptor has a uneven surface, which causes a diffused reflection, resulting in a low image density, or a poor color reproduction with respect to full-color image.

In order to settle the above problems, the present inventor has attempted to smooth the surface of the ink image formed on the porous surface receptor by applying the above-mentioned reheating method. However, in the reheating step, a phenomenon occurred that some portion of the ink of the images adheres to the uncoated area of the recording material transfer to the recording material. Hereinafter, the phenomenon is referred to as reverse transfer. The reverse transfer degrades the quality of the ink image.

It is an object of the present invention to provide a thermal transfer recording material for use in the aforesaid reheating method which does not cause the reverse transfer in the reheating step.

This and other objects of the present invention will become apparent from the description hereinafter.

SUMMARY OF THE INVENTION

The present invention provides a thermal transfer recording material comprising a foundation, and (A) a coated area of at least one heat-meltable ink and (B) a coated area of a release agent or a release composition containing a release agent provided on the foundation, the coated area (A) and the coated area (B) being repeatedly arranged in a side-by-side relation on one side of the foundation, the release agent being at least one member selected from the group consisting of a silicone oil, an alkyl phosphate, a fluorine-containing surface active agent, a silicone resin, a silicone-modified urethane resin, a silicone-modified acrylic resin and a fluorine-containing resin.

DETAILED DESCRIPTION

Figure 1:
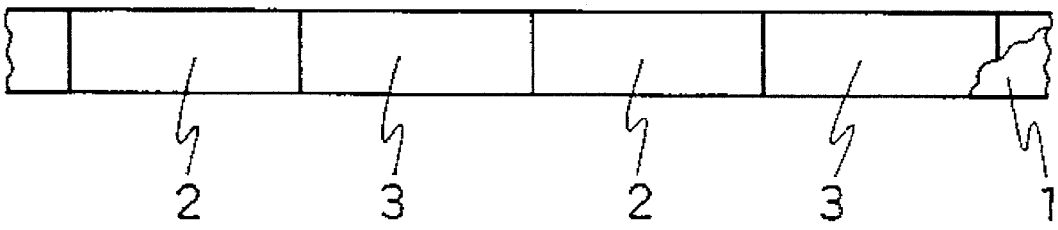
FIG. 1 is a partial plan view showing an example of the thermal transfer recording material of the present invention.

The thermal transfer recording material of the present invention is preferably used in the following way:

In a thermal transfer printer, the coated area of the heat-meltable ink on the thermal transfer recording material is superimposed onto a receptor and the heat-meltable ink is selectively melt-transferred onto the receptor by heating from the back side of the recording material with a heating means such as a thermal head, giving an ink image on the receptor. Then the release agent-coated area of the same recording material is superimposed onto the image-receiving surface of the receptor on which the ink image has been formed and the ink image is heated from the back side of the recording material with the heating means such as a thermal head. In this reheating treatment step, the ink image is heated while contacting the release agent-coated area and, hence, the ink of the image is not transferred to the recording material, namely the reverse transfer does not occur. The ink of the image is again softened or melted by the reheating treatment, with which the depressed portions of the surface of the receptor is filled, resulting in smoothed surface of the ink image. The thus smoothed surface of the ink image causes much less diffused reflection, resulting in an increased image density. In the case that the ink image is a multi-color or full-color image, the reheating treatment improves the color reproduction of the image.

The thermal transfer recording material of the present invention will be explained by referring to the drawings.

FIG. 1 is a partial plan view showing an example of the thermal transfer recording material of the present invention.

The thermal transfer recording material illustrated in FIG. 1 is used for forming a monochromatic image. A coated area 2 of a heat-meltable ink and a coated area 3 of a release agent or a release composition are alternately repeatedly arranged in a side-by-side relation on a foundation 1 in the longitudinal direction thereof.

Usable as the ink for the coated area 2 are a black ink as well as inks in various colors such as blue, red, green and yellow.

Usually the size of the ink-coated area 2 is substantially the same as the size of the release agent-coated area 3. For example, in the case of a thermal transfer recording material having a small width for use with a serial type thermal transfer printer, usually the coated area 2 and the coated area 3 each have a size corresponding to one printing line ( or a size corresponding to plural printing lines for a printer capable of simultaneously printing plural lines). In the case of a thermal transfer recording material having a large width for use with a line type thermal transfer printer, usually the coated area 2 and the coated area 3 each have a size corresponding to a receptor.

Figure 2:
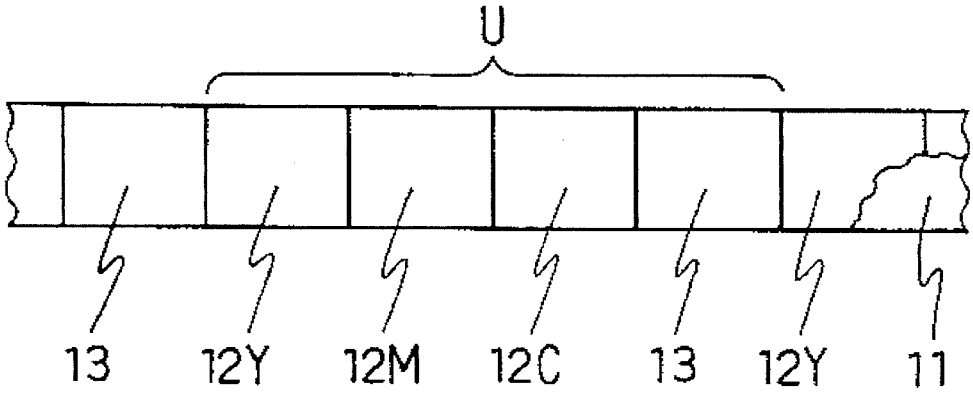
FIG. 2 is a partial plan view showing another example of the thermal transfer recording material of the present invention.

The thermal transfer recording material illustrated in FIG. 2 is used for forming a multi-color or full-color image composed of plural colors. On a foundation 11 are alternately repeatedly arranged a set of a plurality of different color coated areas, for example, a coated area 12Y of a yellow ink, a coated area 12M of a magenta ink and a coated area 12C of a cyan ink, and a coated area 13 of a release agent or a release composition in a side-by-side relation in the longitudinal direction of the foundation 11.

With use of the recording material, at least two of the yellow ink, magenta ink and cyan ink are superimposingly transferred to a receptor in a predetermined order to give a color image on the basis of subtractive color mixture. Accordingly, in usual cases, one coated area 13 is provided relative to one set of the coated areas 12Y, 12M and 12C. Usually the size of each of the coated areas 12Y, 12M and 12C is substantially the same as the size of the release agent-coated area 13. For example, in the case of a thermal transfer recording material having a small width for use with a serial type thermal transfer recording material, usually the coated areas 12Y, 12M and 12C and the coated area 13 each have a size corresponding to one printing line (or a size corresponding to plural printing lines for a printer capable of simultaneously printing plural lines). In the case of a thermal transfer recording material having a large width for use with a line type thermal transfer printer, usually the coated areas 12Y, 12M and 12C and the coated area 13 each have a size corresponding to a receptor.

In the aforesaid thermal transfer recording material for color image formation, a repeating unit U is composed of one set of the coated areas 12Y, 12M and 12C of respective color inks and one coated area 13. The order of arrangement of the coated areas 12Y, 12M and 12C of respective color inks in the repeating unit U may be determined depending upon the order of transfer of the respective color inks. The release agent-coated area 13 is usually arranged so that it appears lastly in the repeating unit U relative to the traveling direction of the recording material. The repeating unit U may further include a coated area of a black ink. .

As the foundation for the recording material of the present invention, usable are polyester films such as polyethylene terephthalate film, polyethylene naphthalate film and polyarylate film, polycarbonate films, polyamide films, aramid films and other various plastic films commonly used for the foundation of ink ribbons of this type. Thin paper sheets of high density such as condenser paper can be used. The thickness of the foundation is preferably within the range of about 1 to 10 μm, more preferably about 1 to 7 μm, for better heat conduction.

On the back side (the side adapted to come into slide contact with a thermal head) of the foundation may be formed a conventionally known stick-preventive layer. Examples of the material for the stick-preventive layer include various heat-resistant resins such as silicone resin, fluorine-containing resin and nitrocellulose resin, and other resins modified with these heat-resistant resins such as silicone-modified urethane resins and silicone-modified acrylic resins, and mixtures of the foregoing heat-resistant resins and lubricating agents.

As the heat-meltable ink used in the present invention, there can be employed any of conventional ones comprising a coloring agent and a heat-meltable vehicle without no particular limitation. The heat-meltable vehicle is composed of a wax and/or a heat-meltable resin as a main ingredient.

Examples of specific waxes include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax and Fischer-Tropsch wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and besamides such as oleic acid amide. These waxes may be used either alone or in combination.

Examples of specific heat-meltable resins include ethylene copolymers such as ethylene-vinyl acetate copolymer, ethylene-vinyl butyrate copolymer, ethylene-(meth)acrylic acid copolymer, ethylene-alkyl (meth)-acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, isoprene polymer, chloroprene polymer, petroleum resins, rosin resins, terpene resins and cumarone-indene resins. These resins may be used either alone or in combination.

As the coloring agent for the monochromatic thermal transfer recording material, usable are carbon black as well as various organic and inorganic pigments.

The coloring agents for yellow, magenta and cyan for the multi-color or full-color thermal transfer recording material are preferably transparent ones.

Examples of specific transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These coloring agents may be used either alone or in combination.

Examples of specific transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These coloring agents may be used either alone or in combination.

Examples of specific transparent coloring agents for cyan include organic pigments such as Victoria Blue Lake, metal-free Phthalocyanine Blue, Phthalocyanine Blue and Fast Sky Blue; and dyes such as such as Victoria Blue. These coloring agents may be used either alone or in combination.

The term "transparent pigment" is herein meant by a pigment which gives a transparent ink when dispersed in a transparent vehicle.

If the superimposing of the three colors, yellow, magenta and cyan, can hardly give a clear black color, there may be further provided a coated area of a black ink containing a coloring agent for black such as carbon black, Nigrosine Base or the like. The black ink for this purpose is not adapted for the superimposing with other color ink and, hence, need not be necessarily transparent. Nevertheless, the black ink is preferably transparent for the purpose of giving a desired color such as blue black by the superimposing with other color ink.

The content of the coloring agent in the heat-meltable ink for each color is preferably about 5 to 30% by weight.

The heat-meltable ink may be incorporated, in addition to the above ingredients, with a dispersant, an antistatic agent and other additives, as required.

The melting point of the heat-meltable ink is preferably from about 50° to 100° C., more preferably from about 50° to 90° C., still more preferably from about 50° to 85° C. When the melting point is lower than the above range, the storage property of the recording material is prone to degrade. When the melting point is higher than the above range, the transfer sensitivity is prone to degrade.

The coating amount ( the value after drying, hereinafter the same) of the ink is preferably from about 1 to 5 g/m$^2$.

The thermal transfer recording material of the present invention is preferably applied to a paper sheet having a low surface smoothness, for example, a Bekk smoothness of 50 seconds or less, or a porous surface receptor. In this case, a heat-meltable ink having a melt viscosity of 20 to 200 cps/90° C. is preferably used. Such a low viscosity ink easily permeates into the depressed portions of the paper sheet or the minute pores and depressed portions of the porous surface receptor and images formed from the ink are easily smoothed in the reheating treatment, which results in ink images having excellent abrasion resistance and surface smoothness. When the melt viscosity of the ink is higher than the above range, the ink is difficult to permeate into the depressed portions of the paper sheet or the minute pores and depressed portions of the porous surface receptor and to be smoothed. When the melt viscosity of the ink is lower than the above range, the ink is prone to excessively permeate into the paper sheet or flow on the surface of the porous surface receptor.

The release agent applied to the uncoated areas of the heat-meltable ink on the foundation may be a liquid release agent or a solid release agent. Examples of the liquid release agent are silicone oil, phosphoric acid alkyl esters and fluorine-containing surface active agent. Examples of the solid release agent are silicone resin, silicone-modified urethane resin, silicone-modified acrylic resin and fluorine-containing resin.

The release agent may be applied in the form of a release composition containing the release agent. The release composition comprises a release agent and a binder such as resins. Usable examples of the resin as the binder include nitrocellulose, urethane resin, polyester resin, natural rubber, styrene-butadiene copolymer, isoprene polymer and chloroprene polymer. These resins may be used either alone or in combination. The content of the release agent in the release composition is preferably from 0.5 to 20% by weight.

The coating amount of the release agent is preferably from 0.001 to 5 g/m$^2$, more preferably from 0.001 to 1 g/m$^2$. When the release agent is liquid, the coating amount thereof is preferably from 0.001 to 0.05 g/m$^2$. The coating amount of the release composition is preferably from 0.001 to 5 g/m$^2$, more preferably from 0.001 to 1 g/m$^2$ in terms of the release agent. The coating amount of the release composition is preferably from 0.2 to 5 g/m$^2$ on the basis of the amount of the release composition itself. When the coating amount of the release agent or release composition is smaller than the above range, the release effect is not sufficiently exhibited in the reheating treatment. When the coating amount is larger than the above range, the heat conduction is prone to degrade, which results in an unfavorable reheating treatment.

The thermal transfer recording material of the present invention exhibits favorable results when being used in combination with a receptor having a porous surface layer having a large number of minute pores.

Usable as such a porous surface receptor is one disclosed in Japanese Unexamined Patent Publication No. 41287/1990. The porous surface receptor is prepared as follows: Two or more kinds of resins which are immiscible or less miscible with each other (for example, a combination of a homopolymer or copolymer of vinyl chloride and a homopolymer or copolymer of acrylonitrile) is dissolved into a solvent. The solution is applied onto a film substrate such as polypropylene film or polyester film. The resultant is passed through a liquid which is miscible with the solvent and incapable of dissolving the resins, thereby coagulating the resins, followed by drying. Thus a porous resinous layer is formed on the film substrate. The porous resinous layer is brought into contact with a smooth sheet material which is incompatible with the porous resinous layer and subjected to a heating treatment under a pressure to give a receptor having a porous surface layer.

The porous surface layer preferably has an average pore diameter of 0.1 to 10 μm, especially 0.5 to 5 μm, an average pore depth of 0.5 to 15 μm, especially 2 to 10 μm, and an average pore density of $5\times10^5$ to $1\times10^7$/mm$^2$.

The porous surface layer preferably has a softening or melting temperature of 40° to 150° C. Such a porous surface layer is softened to be smoothed together with the ink images during the reheating treatment, thereby facilitating smoothing of the ink images. When the softening or melting temperature of the porous surface layer is higher than 150° C., the porous surface layer is not softened in the reheating treatment, resulting in no contribution to the smoothing of the ink images. When the softening or melting temperature of the porous surface layer is lower than the above range, the porous surface layer has tackiness, which causes problems in storage and feeding in a printer.

The present invention will be more fully described by way of Examples. It is to be understood that the present invention is not limited to the Examples, and various changes and modifications may be made in the invention without departing from the spirit and scope thereof.

EXAMPLE 1

Onto one side of a 3.5 μm-thick polyethylene terephthalate film which was provided on the other side thereof with a 0.1 μm-thick stick-preventing layer composed of a silicone-modified urethane resin were applied the inks for respective colors each having the composition shown in Table 1 by hot-melt coating. Onto the areas not coated with ink on the film foundation was applied a silicone oil in a coating amount of 0.005 g/m$^2$. Thus there was obtained a thermal transfer recording material wherein the coated areas of the different color inks and the coated area of the release agent were arranged as shown in FIG. 2.

TABLE 1

| | Yellow ink | Magenta ink | Cyan ink |
|---|---|---|---|
| Formula (parts by weight) | | | |
| Paraffin wax | 60 | 60 | 60 |
| Carnauba wax | 20 | 20 | 20 |
| Ethylene-vinyl acetate copolymer | 5 | 5 | 5 |
| Pigment Yellow | 15 | — | — |
| Carmine 6B | — | 15 | — |

TABLE 1-continued

| | Yellow ink | Magenta ink | Cyan ink |
|---|---|---|---|
| Cyanine Blue KRO | — | — | 15 |
| Coating amount (g/m$^2$) | 1.5 | 1.5 | 1.5 |
| Melting point (°C. ) | 71 | 71 | 71 |
| Melt viscosity (cps/90° C.) | 140 | 140 | 140 |

EXAMPLE 2

The same procedures as in Example 1 except that a solution of a silicone-modified acrylic resin in methyl ethyl ketone (solid content: 8% by weight) was applied onto the uncoated areas of the inks on the film foundation at a coating amount after drying of 0.2 g/m$^2$ and dried to give release agent-coated areas were repeated to give a thermal transfer recording material.

COMPARATIVE EXAMPLE

The same procedures as in Example 1 except that the silicone oil was not applied onto the areas not coated with ink on the film foundation were repeated to give a thermal transfer recording material.

With use of each of the thermal transfer recording materials, the yellow ink, the magenta ink and the cyan ink were transferred in this order to a porous surface receptor specified below under conditions specified below on a thermal transfer printer to form a transferred part (Y) of the yellow ink, a transferred part (M) of the magenta ink, a transferred part (C) of the cyan ink, a superimposedly transferred part (Y/M) of the yellow ink and the magenta ink, a superimposedly transferred part (M/C) of the magenta ink and the cyan ink, a superimposedly transferred part (Y/C) of the yellow ink and the cyan ink, and a superimposedly transferred part (Y/M/C) of the yellow ink, the magenta ink and the cyan ink. Then the coated area of the release agent of the recording material was superimposed onto the ink image-bearing surface of the receptor and the ink images were heated by operating the thermal head under the same conditions as in transfer of the inks except that solid printing condition was adopted.

Thermal transfer printer:

SP-2200 made by Victor Company of Japan, Limited

Printing energy: 0.4 W/dot

Printing speed: 10 msec/line

Porous surface receptor: made by NISSHINBO INDUSTRIES, INC., softening temperature of the porous surface layer: 80 ° C., average pore diameter: 1 μm, average pore depth: 10 μm, average pore density: $10^6$/mm$^2$ The optical reflection density (OD value) was determined with the ink images before and after the reheating treatment. The results are shown in Table 2.

TABLE 2

| | Example 1 | | Example 2 | | Comparative Example | |
|---|---|---|---|---|---|---|
| Transferred parts | Before reheating | After reheating | Before reheating | After reheating | Before reheating | After reheating |
| OD value | | | | | | |
| Y | 1.22 | 2.03 | 1.22 | 2.01 | 1.22 | 1.20 |
| M | 1.18 | 1.98 | 1.18 | 1.96 | 1.18 | 1.15 |
| C | 1.21 | 2.10 | 1.21 | 2.05 | 1.21 | 1.18 |
| Y/M/C | 1.30 | 1.90 | 1.30 | 1.89 | 1.30 | 1.26 |

Further the transferred parts Y/M, M/C and Y/C after the reheating were evaluated for color reproducibility. All transferred parts provided good color reproducibility.

As described above, when ink images are formed on a porous surface receptor and the ink images are subjected to the reheating treatment by use of the thermal transfer recording material of the present invention, ink images having smooth surface and high density are obtained without reverse transfer. An excellent color reproducibility is exhibited in formation of color ink images.

When ink images are formed on a paper sheet having an uneven surface and the ink images are subjected to the reheating treatment by use of the recording material of the present invention, ink images having excellent abrasion resistance are obtained.

In addition to the materials and ingredients used in the Examples, other materials and ingredients can be used in the Examples as set forth in the specification to obtain substantially the same results.

What is claimed is:

1. A method for forming an image comprising the steps of:

providing a thermal transfer recording material comprising a foundation, and (A) a coated area of at least one heat-meltable ink and (B) a coated area of a release agent or a release composition containing a release agent provided on the foundation, the coated area (A) and the coated area (B) being repeatedly arranged in a side-by-side relationship one side of the foundation, the release agent being at least one member selected from the group consisting of a silicone oil, an alkyl phosphate, a fluorine-containing surface active agent, a silicone resin, a silicone-modified urethane resin, a silicone-modified acrylic resin and a fluorine-containing resin, superimposing the coated area (A) of the recording material onto a receptor having a resinous porous surface layer, and heating the recording material from the back side thereof with a thermal head to selectively melt-transfer the heat-meltable ink of the coated area (A) onto the resinous porous surface layer of the receptor, thereby giving an ink image on the receptor, and superimposing the coated area (B) of the recording material onto the resinous porous surface layer on which the ink image has been formed, and heating the recording material from the back side thereof with the thermal head to heat the ink image.

2. The method of claim 1, wherein the resinous porous surface layer of the receptor has an average pore diameter of 0.1 to 10 μm, an average pore depth of 0.5 to 15 μm and an average pore density of $5\times10^5$ to $1\times10^7/mm^2$.

3. The method of claim 1, wherein the coated area (A) comprises a coated area of a yellow heat-meltable ink, a coated area of a magenta heat-meltable ink and a coated area of a cyan heat-meltable ink, and at least two of said inks are superimposingly transferred onto the resinous porous surface layer of the receptor in a predetermined order, thereby giving a color image on the basis of subtractive color mixture.

4. The method of claims 3, wherein the coated area (A) further comprises a coated area of a black heat-meltable ink.

5. The method of claim 1, wherein the heat-meltable ink has a melt viscosity of 20 to 200 cps/90° C.

6. The method of claim 1, wherein the coating amount of the release agent in the coated area (B) is from 0.001 to 5 $g/m^2$.

7. The method of claim 1, wherein the coating amount of the release composition in the coated area (B) is from 0.001 to 5 $g/m^2$ in terms of the release agent.

* * * * *